US006464107B1

(12) United States Patent
Brugger

(10) Patent No.: US 6,464,107 B1
(45) Date of Patent: Oct. 15, 2002

(54) DOSAGE DISPENSER

(76) Inventor: Anton Brugger, Schongauerstr. 10, Marktoberdorf (DE)

( * ) Notice: Subject to any disclaimer, the term of this patent is extended or adjusted under 35 U.S.C. 154(b) by 0 days.

(21) Appl. No.: 09/762,770

(22) PCT Filed: Aug. 16, 1999

(86) PCT No.: PCT/DE99/02568

§ 371 (c)(1),
(2), (4) Date: Apr. 2, 2001

(87) PCT Pub. No.: WO00/09270

PCT Pub. Date: Feb. 24, 2000

(30) Foreign Application Priority Data

Aug. 14, 1998 (DE) ..... 198 37 034

(51) Int. Cl.[7] ..... B67D 5/52

(52) U.S. Cl. ..... 222/134; 222/137; 222/145.5; 222/145.8; 222/309

(58) Field of Search ..... 222/134, 137, 222/145.3, 145.5–145.8, 288, 309

(56) References Cited

U.S. PATENT DOCUMENTS

| | | | | | |
|---|---|---|---|---|---|
| 4,454,964 | A | * | 6/1984 | Sacher | 222/309 |
| 4,826,048 | A | * | 5/1989 | Skorka et al. | 222/137 |
| 5,224,627 | A | | 7/1993 | Weag | 222/135 |
| 5,634,571 | A | * | 6/1997 | Cataneo et al. | 222/145.8 |
| 5,848,732 | A | * | 12/1998 | Brugger | 222/148.8 |

FOREIGN PATENT DOCUMENTS

| | | |
|---|---|---|
| DE | 198 18 434 A1 | 10/1999 |
| EP | 0 755 721 A2 | 1/1997 |
| JP | A 54-137703 | 10/1979 |
| WO | WO 97/26086 | 7/1997 |

* cited by examiner

*Primary Examiner*—Joseph A. Kaufman
(74) *Attorney, Agent, or Firm*—Oliff & Berridge PLC

(57) ABSTRACT

A proportioning dispenser for proportioning at least two components which are each supplied via a pump unit from an associated accommodating compartment is disclosed. The adjustment of the mixing ratio is effected via a transmission member the point of application of which is adjustable with respect to the two pump units.

18 Claims, 6 Drawing Sheets

DOSAGE DISPENSER

BACKGROUND OF THE INVENTION

1. Field of Invention

The invention relates to a proportioning dispenser for proportioning at least two components in an adjustable ratio.

2. Description of Related Art

From EP 0 755 721 A2 and DE 198 18 434, a proportioning dispenser is known, wherein the mixing ratio of two pasty or liquid fluid components may be adjusted continuously. Such a proportioning dispenser may, for example, in a particularly advantageous manner be used as a sun lotion dispenser for mixing two sun lotion components having sun protection factors of 1 and 25, for example, so that the sun protection factor may be adjusted continuously in the range from 1 to 25. This novel proportioning dispenser constitutes a considerable convenience to the consumer as he may choose the sun protection factor depending on the isolation and the degree of the skin's adaptation, while no more having to carry along several containers with different sun protection factors. The subject matter of DE 198 18 434 represents a further development of the proportioning dispenser disclosed in EP 0 755 721 A2, wherein due to a particular design of the cartridges and the pump arrangement a reduction of the axial length of the proportioning dispenser becomes possible.

In the solutions proposed in EP 0 755 721 A2 and in DE 198 18 434, the proportioning dispenser includes two pumps each having associated a replaceable cartridge, wherein a respective type of sun lotion (sun protection factor 1 or 25, for example) is contained. The pumps are actuated by means of two eccentric levers which are operatively connected with a pump head or nozzle head mounted in a housing of the proportioning dispenser and actuated by the consumer.

The adjustment of the mixing ratio is effected by adjusting the stroke of the pump plunger. The pumps are mounted pivotally with the lever length of the eccentric lever acting on the pump being adjustable. This lever length is determined by the distance between the pivotal mount and the point of application of the pump head on the eccentric lever. The adjustment is effected by means of a cam disc connected with the turning knob, the cam guide of which guides two cam follower pins of a guide bracket. The latter encompasses the two pumps so as to ensure their simultaneous rotation. The pivoting motion of the pumps is made possible by a ball joint.

Concerning further details of this proportioning dispenser, reference is made of DE 198 18 434.4, the disclosure of which is fully incorporated herewith by way of reference.

The known proportioning dispensers have proved their worth in practice, however, they still have the defect in the detail that the adjustment mechanism for adjusting the mixing ratio has a comparably complicated design. The requirement of the two cartridges having to be pivotably mounted in the ball joints is comparably complicated and expensive.

SUMMARY OF THE INVENTION

As against that, the object underlying the invention is to provide a proportioning dispenser having an adjusting mechanism for the individual pumps and being simple in its construction and reliable as to its operation.

This object is achieved by a proportioning dispenser with at least two components each accommodated in an accommodating compartment, pump means in communication with each of the accommodating compartments and a dispenser nozzle for discharging the components. The proportioning dispenser also has an adjustment means operationally connected to the pump means that adjusts the quantitative portion of the components. The adjustment means comprises a pivotable transmission member which indirectly or directly contacts the pump means for the operation thereof. The transmission member has a pivoting axle which can be adjusted with respect to the pump so that the displacement value of the pump can be adjusted in response to the relative position of the pivoting axis.

According to the invention, the actuation of the pump units is performed by a pivotable or displaceable transmission member the pivoting axle of which can be displaced relative to the operating members of the pump unit—for example the displacers. Thus, it is made possible to change the point of application of the transmission member at the pump units and thus their stroke by changing the position of the pivoting axle relative to the pump units. The position of the pivoting axle relative to the pump units is in this case selected to effect a change in the opposite direction, such that only the proportioning ratio of different components relative to one another is adjusted while the complete capacity preferably remains essentially constant. It is also conceivable, however, to adjust the complete displacement volume by adjusting the pivoting axle. Both components can be dispensed in a mixed or unmixed condition.

The solution according to the invention has an essentially simpler design as compared to the proportioning dispensers described at the beginning, as the pump units do not have to be articulated in the housing anymore, so that the number of movable components is reduced. Due to the upright arrangement of the pump units, the proportioning dispenser can be designed in a manner essentially more compact than the construction described above.

Principally, two equivalent alternatives for adjusting the pivoting axle are available. First of all, the pivoting axle can be embodied at the transmission member, so that the adjustment of the stroke is performed by the rotation or displacement of the transmission member and the pivoting axle. As an alternative, the transmission member can be stationarily accommodated in the housing while the pivoting axle supporting the transmission element is rotated or displaced.

By means of the adjustment of the pivoting axle with respect to the pump units, the transmission member practically performs a wobbling with respect to the pump units during the adjustment operation, with the point of application of the transmission member on the pump units being changed with respect to the pivoting axle.

In both variants, the transmission member is biased with an end section against the pump units in an appropriate manner, while a section of the transmission member spaced apart is mounted in the housing via the pivoting axle. The pivoting axle can be mounted or fixed in a rotatable or displaceable part of the housing.

It is particularly advantageous for the pivoting axle to be accomodated in a rotatable housing head of the proportioning dispenser.

According to the invention, the transmission member preferably has a plate-shaped, disk-shaped or annular design.

In particular in the variant where the pivoting axle can be rotated together with the housing head, the housing head is preferred to comprise an opening spaced apart from the axle of rotation through which a section of the transmission member extends. Thereby, in a simple manner a handle for pivoting the transmission member is provided.

In this embodiment, it is particularly advantageous for the dispenser nozzle to be arranged diametrally to the handle.

In the prior art described at the beginning, the components had to be conveyed to the mixing chamber via tube connections due to the pivotability of the pump units. In contrast, the concept according to the invention makes it possible to design the outlet and inlet valves associated to the pump units in chambers which are connected with the pump units via solid housing channel. In this case, it is preferred for the outlet valves of the pump units, to end in a common outlet chamber while the inlet valves arranged between the pump unit and the accommodation compartment each are arranged in a separate inlet chamber.

The proportioning dispenser can be designed in a particularly compact manner with a short axial length if the above mentioned chambers are arranged in the region between the pump units, so that the mixture can be dispensed from the common outlet chamber for example centrally.

In the variant in which the transmission member is stationarily accommodated in the pump housing and the pivoting axle is rotated or displaced with respect to the transmission member, the displacers of the pump units, for example the plungers of a reciprocating pump, can be connected with the transmission member such that the latter forms at least a part of the outlet chamber. That is, in this variant, the transmission member is designed as a hollow body in which optionally the outlet valves of the individual pump units are arranged. The mixture can then be centrally withdrawn from the transmission member.

The pump units can be embodied as reciprocating pump, as bellows pump or in another construction.

Depending on the viscosity of the components, the accommodating compartments can be embodied by cartridges (as in the prior art described at the beginning), as bag or as bottle with an integrated suction tube. The latter variant can be used in a particularly advantageous manner for liquid media.

In special applications, it can be advantageous for the accommodating compartments, for example the cartridges, to be axially displacably mounted in the housing and for the adjustable transmission member to act on the accommodating compartments, so that the operation of the pump units is effected via the displaceable cartridges. That is, in this embodiment, the displacers of the pump units are stationarily accomodated in the housing while the cylinders limiting the displacer rooms together with the displacers communicate with the axially displaceable accommodating compartments, so that by displacing the accommodating compartments an enlargement or a reduction in size, respectively, of the displacer room is effected. This variant practically represents a kinematic reversal of the conventional operating principle with movable displacers.

Other advantageous further developments of the invention are the subject matter of the further subclaims.

BRIEF DESCRIPTION OF THE DRAWINGS

In the following, preferred embodiments of the invention are illustrated more in detail with reference to schematic drawings, wherein.

DETAILED DESCRIPTION OF PREFERRED EMBODIMENTS

Figure 1A:
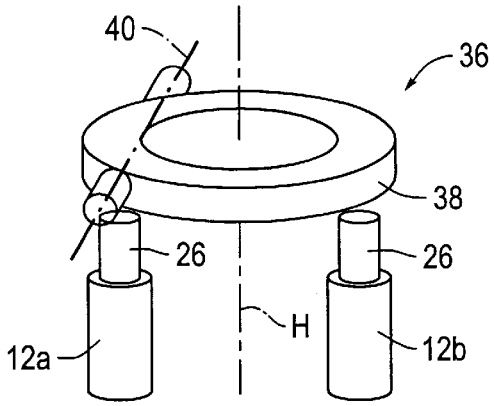
FIGS. 1A to 1F show a representation of the principle of the adjustment concept according to the invention in which the pivoting axle is adjustable relative to the pump units.

With reference to FIGS. 1A to 1F, first of all the basic concept of the proportioning dispenser according to the invention will be described, according to which the adjustment of the mixture is effected by rotating or displacing a pivoting axle 40 of a transmission member 38 with respect to several pump units 12*a*, 12*b*, which are indirectly or directly operated by means of the transmission member 38. In principal, here the pivoting axle 40 can be fixed to the transmission member 38 and thus adjusted together with the same relative to the pump units. In a kinematic reversal, the position of the pivoting axle 40 with respect to the transmission member 38 can also be changed.

In accordance with FIGS. 1A to 1F, an adjustment means 36 for a proportioning dispenser in accordance with the invention, generally shown under reference numeral 36, essentially comprises a transmission member 38 which has a plate-shaped, disk-shaped or annular design in the represented embodiment. The transmission member 38 can be rotated about a vertical axis H illustrated by a dash-dotted line in FIG. 1A, and moreover it can be pivoted about a pivoting axle 40 extending perpendicularly to the vertical axis.

The bottom side of the transmission member 38 contacts the pump heads 26 of two pumps 12*a* and 12*b* or may be taken into contact with these pump heads 26, respectively, so that by pivoting the transmission member 38 a pump stroke can be started.

Figure 1B:
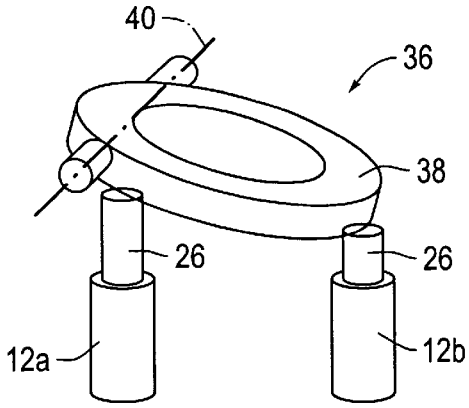
Figure 1C:
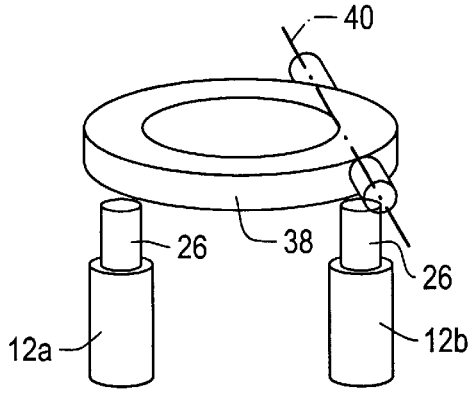
Figure 1D:
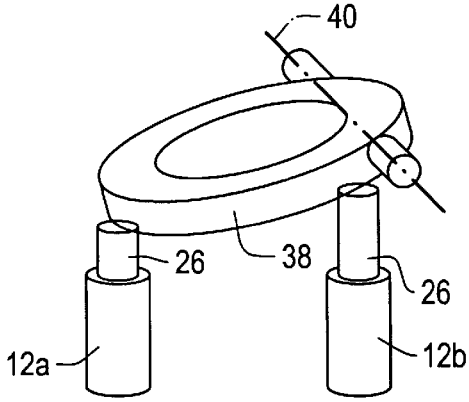
Figure 1E:
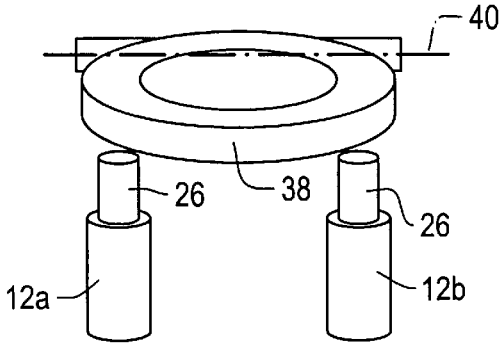
Figure 1F:
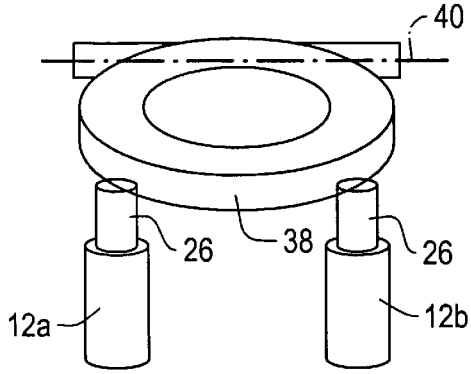

FIGS. 1A, 1C and 1E each show the condition in which the annular or disk-shaped transmission member 38 is not pivoted about its axle 40, and FIGS. 1B, 1D and 1F each show conditions in which this transmission member 38 is pivoted downwards about its axle 40.

Pivoting or depressing the transmission member 38 about its axle 40 may, e.g., be effected by means of a nozzle head (not shown) to be manually actuated wherein the outlet or dispenser nozzle for the mixture can also be arranged. Moreover, the transmission member 38 may be rotated by means of this nozzle head, so that the position of the pivoting axle 40 changes with respect to the pumps 12*a* and 12*b*, as can be directly taken from FIGS. 1A to 1F. For example, the transmission member 38 can be mounted by means of the pivoting axle 40 in a bearing or mount stationarily connected with the nozzle head and bringing about a rotation of the transmission member 38 upon a corresponding rotation of the nozzle head from the outside.

FIG. 1A shows a neutral position of the transmission member 38, where the same has a substantially horizontal orientation to exert no pressure on the pump heads 26 of the pumps 12*a* and 12*b*. This neutral position is preferably spring-supported, i.e., the transmission member 38 assumes the neutral position without the influence of an external force, e.g. by a spring, and returns to this position after the influence of a force.

If the transmission member 38 is, for example, depressed or displaced by depressing the nozzle head, it performs a pivoting movement about the pivoting axle 40 in accordance with FIG. 1B, so that only the pump head or the displacer 26 of the right-hand pump 12*b* in FIG. 1B is depressed. As a result, the pump 12*b* has a 100% stroke or displacement volume. The pump 12*a*, which is not influenced by a force as it is located underneath the pivoting axle 40, has a 0% stroke or displacement volume (on the complete supplied amount). The supplied amount only contains constituents of the component supplied by the pump 12*b*.

When the transmission member 38 is, for example, rotated by 180° with respect to the position shown in FIG. 1A by means of the nozzle head or another suitable means, the transmission member 38 assumes the position according to FIG. 1C in its neutral position, wherein the pivoting axle 40 is adjacent to the pump head 26 of the right-hand pump 12*b* or located above it, respectively. If, starting from the position in accordance with FIG. 1C, the transmission member 38 is pivoted downwards about its pivoting axle 40, the left-hand pump 12*a* now performs a stroke (displacement volume of 100%), while the right-hand pump 12*b* arranged below the pivoting axle does not perform a stroke or has a displacement volume of 0%. The supplied amount only contains constituents of the component supplied by the pump 12*a*.

Upon a 90° rotation of the transmission member 38 starting from the position in accordance with FIG. 1A or 1C, an orientation of the pivoting axle 40 in accordance with FIG. 1E is obtained, the same extending at a parallel distance to the connecting line of both pumps 12*a*, 12*b*. If, starting from the position in accordance with FIG. 1E, the transmission member 38 is depressed, the two displacers 26 of the pumps 12*a* and 12*b* are pushed downwards by the same path, so that both pumps have an identic stroke or displacement volume of 50% of the complete supplied amount. The mixture contains equal parts of both components.

Corresponding intermediate positions of the transmission member 38 or of its axle 40, respectively, result in corresponding intermediate ratios of the strokes or displacement volumes of the pumps 12*a* and 12*b*, so that these are continuously variable between 0%:100% and 100%:0% for each component.

In the above described construction, the pivoting axle 40 is designed as axle journal tangentially projecting from the circumferential rim of the annular or plate-shaped transmission member 38. That is, the relative position of the pivoting axle 40 is effected by a common rotation of the transmission member 38 and the pivoting axle 40.

Figure 2B:
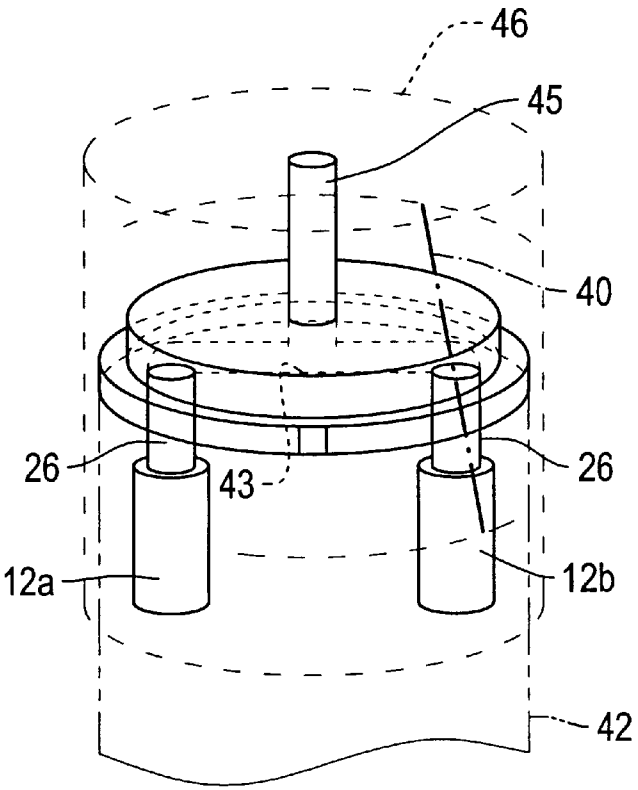
FIGS. 2A, 2B show an embodiment in which the transmission member is stationarily accomodated in the pump housing and the pivoting axle can be adjusted with respect to the transmission member.
Figure 2A:
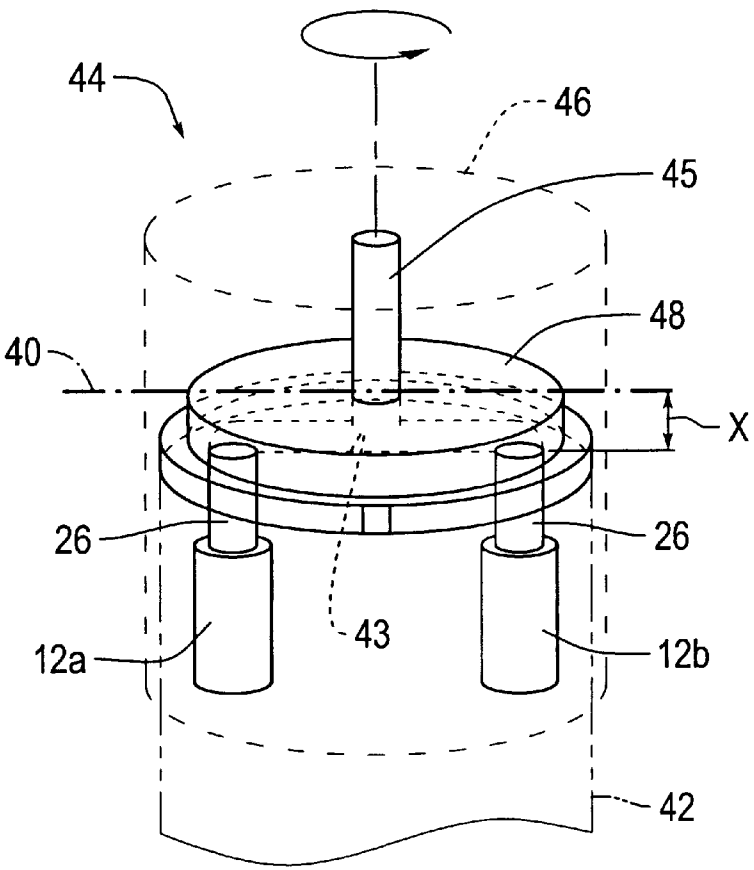

In the embodiment represented in FIG. 2, a kinematic reversal is performed to the effect that the transmission member 38 is accomodated stationarily but rotatably in an indicated housing 42 of a proportioning dispenser 44. A rotatable housing head 46 is mounted on this for example cylindric housing 42, at the internal circumferential walls of which the pivoting axle 40 is mounted. That is, the pivoting axle 40 penetrates the interior space encompassed by the housing head 46 at least in sections. The transmission member 38 pivotably mounted in the housing 42 is supported on the pivoting axle 40 with a circumferential section 48, so that it can be pivoted to a region of the transmission member spaced apart from the pivoting axle 40 when a force is applied.

Both pump units 12*a*, 12*b* contact with their displacers 26 the in FIG. 2 lower front face of the transmission member 38.

In the represented concept of construction, the transmission member 38 is designed as a disk-shaped hollow body which is connected with the displacers 26. The supply of the components is effected through the displacers into a transverse channel 43 of the stationary transmission member 38. An axial channel 45 through which the componets are conveyed to the non-depicted dispenser nozzle ends in this transverse channel. Thus, the transmission member 38 is a part of a mixing chamber at the outlet side. In the rotating position of the housing head 46 represented in FIG. 2A, there is an imaginary connecting line between the two displacer axes at a parallel distance X to the pivoting axle 40.

That is, in this relative position, when pivoting the transmission member 38, both displacers 26 are moved by the same stroke, so that the amount supplied by the dispenser nozzle consists of both components at equal proportions. In the representation according to FIG. 2B, the housing-head 46 is rotated with respect to the housing 42, so that the pivoting axle 40 is set transverse to the imaginary connecting line of the pump units 12*a*, 12*b* (in the basic position according to FIG. 2A). That is, due to the change of the position of the pivoting axle 40, the point of support of the stationarily mounted transmission member 38 changes, so that the same performs a kind of "wobbling" when the housing head 46 is rotated. Due to this wobbling, the point of application of the transmission member 38 at the right pump unit 12*b* is reduced by the quantity X, while the point of application of the transmission member 38 at the pump unit 12*a* represented in the left is enlarged by this quantity X. Correspondingly, the displacer 26 of the pump unit 12*a* performs a grater stroke than the displacer 26 of the pump unit 12*b* when the transmission member 38 is pivoted, so that the supplied amount comprises a higher proportion of the component supplied via the pump unit 12*a*. The proportion of the component supplied by the pump unit 12*b*, however, is nearly 0 when the pivoting axle for example intersects the axle of the pump unit 12*b*. The proportion of the component supplied by the pump unit 12*b* can be enlarged by rotating the pivoting axle 40 towards the pump unit 12*a*.

Corresponding to the above statements, the principle according to the invention is based on changing the relative position of a pivoting axle 40 with respect to several pump units 12 and to operate all pump units via a common transmission member 38. For the principle according to the invention, it does not matter whether the pivoting axle is displaced or rotated together with the transmission member or with respect to the transmission member.

Figure 3:
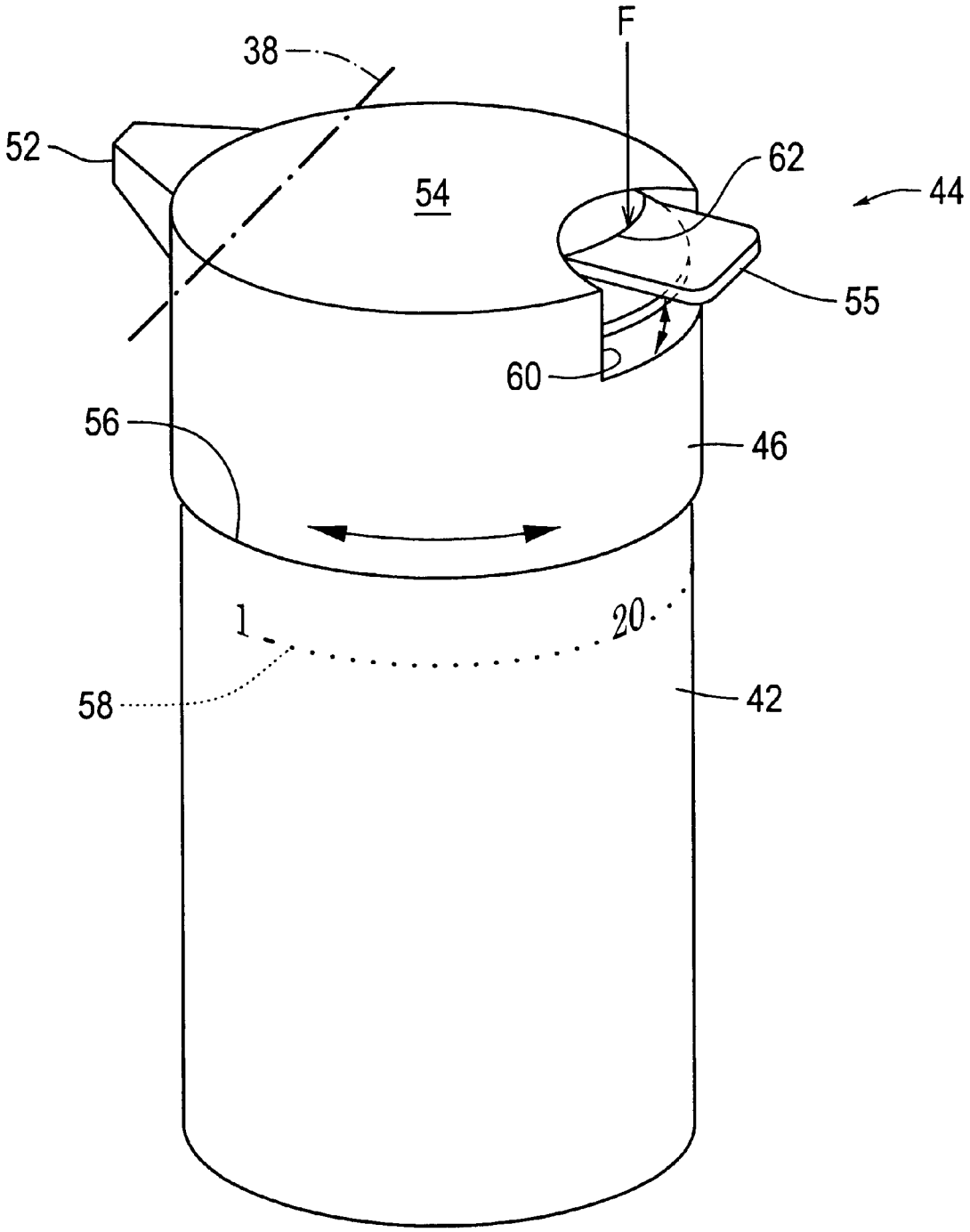
FIG. 3 shows a three-dimensional view of a proportioning dispenser having a rotatable housing head.

FIG. 3 shows a very simplified view of a proportioning dispenser 44 according to the invention having a housing 42 in which accommodating compartments for the components to be described more in detail as follows are included. The housing 42 carries the rotatable housing head 46 at which a dispenser nozzle 52 is embodied. The mixture adjusted by means of the stroke of the pump units 12 exits through this nozzle. The adjustment of the mixture is effected by rotating the housing head 46 with respect to the housing 42, and for example at the housing head 46 a marking 56 is applied which is caused to overlap with a scale 58 in order to adjust a predetermined proportioning ratio. In the embodiment represented in FIG. 3, the concept of the invention indicated with reference to FIGS. 1A to 1F is to be realised, i.e. the transmission member 38 is rotated together with the pivoting axle 38 indicated by a dot-dash line over the housing head 46. In the represented embodiment, in the region of the circumferential rim of the front face 54 an opening 60 is formed, so that an operating section 62 of the transmission member 38 is cut free. This operating section 62 is spaced apart from the pivoting axle 38, so that the transmission member 38 can be pivoted by applying an operating force F to the operating section 62 and thus a delivery stroke of the pump units 12 can be caused. Naturally, the housing head 46 cut free can also be used in the embodiment represented in FIGS. 2A, 2B having a stationary transmission member.

Alternatively, the housing head 46 could also be guided on the housing 42 in an axially displaceable manner, at the inner surface of the housing head 46 an operating pin being for example embodied, which can be contacted with the operating section 62 of the transmission member 38 by axially displacing the housing head 46, so that a pivot about the pivoting axle 38 is also effected.

Figure 4:
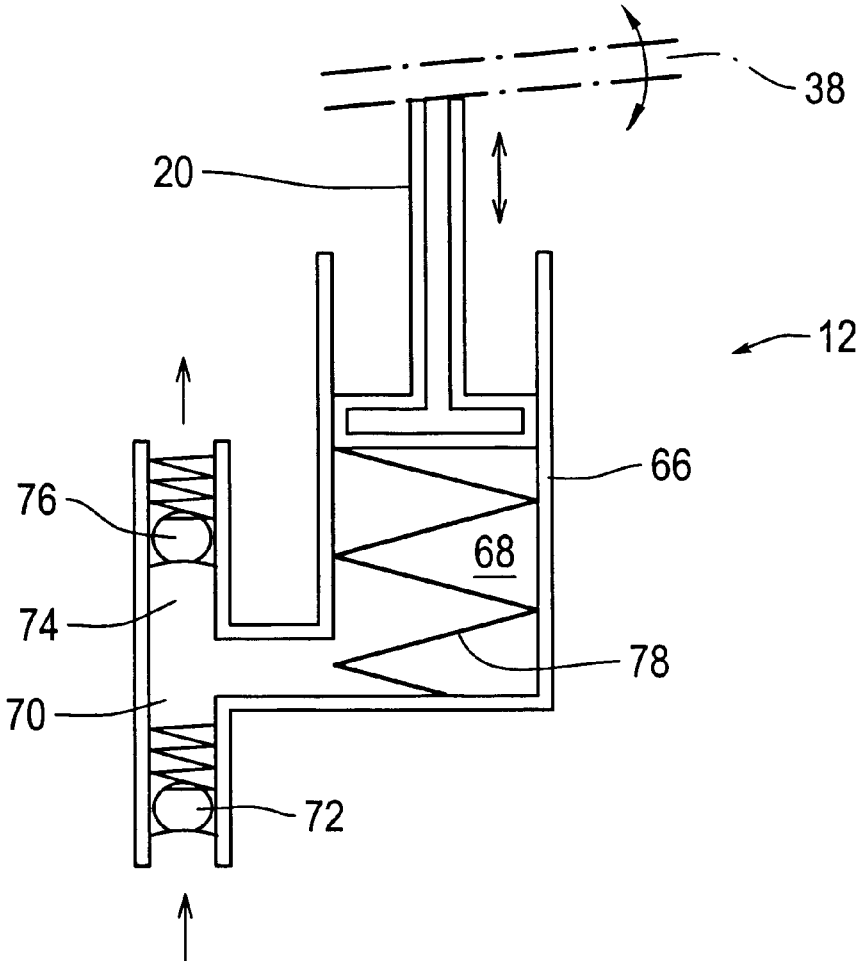
FIG. 4 shows a representation of the principle of a pump unit with inlet and outlet valves.

FIG. 4 shows a schematic section through one of the pump units 12. The pump unit 12 is designed as a reciprocating pump. As already mentioned at the beginning, this pump unit, however, can also be designed according to other operating principles, for example as a bellows pump, a diaphragm pump or in a similar design.

According to FIG. 4, the displacer or plunger 26 is guided in a cylinder 66 to be axially displaceable, so that a displacer room 68 is limited by the plunger and the cylinder 66. In the known solutions mentioned in the beginning, the component was supplied through the plunger 26, which was connected with a suitable outlet valve in the outlet region. The outlet of this outlet valve communicated with a mixing chamber via a tube. In this variant, it is a disadvantage that the assembly of this tube and the design of the plunger 26 is comparable complicated, so that considerable efforts as to the manufacture are required. Furthermore, in this known solution, considerably pressure losses aggravating the delivery of highly viscous components can occur.

The embodiment of the outlet channel formed by a tube was necessary because of the pivot of the pump units. As in the concept according to the invention the pump unit 12 is stationarily accomodated in the housing, the use of such tubes can be dispensed with, so that the construction is essentially simpler.

According to the invention, an inlet channel 70 formed by a housing wall ends in the displacer room 68, in which channel an inlet valve 72 is arranged, so that during an intake stroke of the plunger 26, a component can be taken in from an accommodation compartment into the displacer room 68 in the direction of the arrow. When the displacer room 68 is reduced in size (delivery stroke), the upstroke valve 72 formed as a return valve is closed and the component to which a pressure is applied is discharged from the displacer room 68 via a pressure channel 74. This pressure channel 74 ends in a proportioning or mixing chamber to be described more in detail in the following, in which the individual components are brought together. Here, a thorough mixing of the components can be effected; however, they can also pass through the proportioning/mixing chamber without being mixed. A backflow of the component to which a pressure is applied is avoided by a pressure valve 76 equally designed as a return valve.

In the embodiment represented in FIG. 4, the two valves 72, 76 are designed as ball valves, of course, other valve constructions, for example plate valves, can also be used.

In this embodiment, all channels for conveying the component are formed by solid housing walls, so that the assembly and the manufacture is simplified with respect to the solution mentioned at the beginning.

The operation of the plunger 26 is effected by pivoting the transmission member 38 indicated by a dot-dash line.

The plunger 26 is biased in its contact position against the transmission member 38 via a pressure spring 78. FIG. 5 shows a section through a housing head 46 according to FIG. 3, in which two pump units 12*a*, 12*b* are accomodated according to FIG. 4.

Figure 5A:
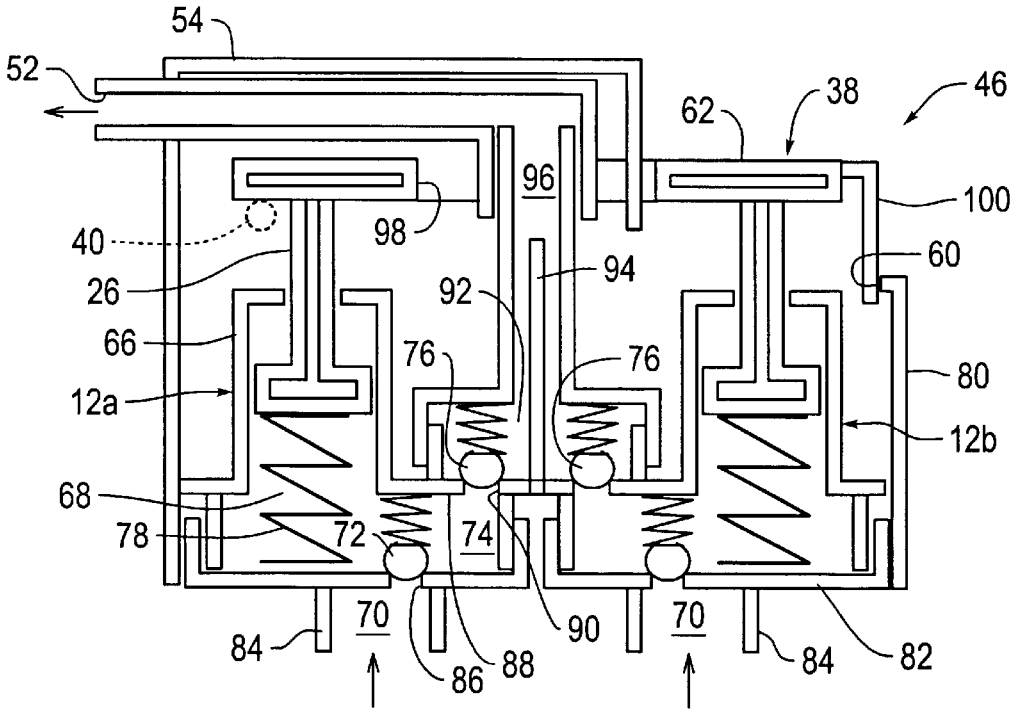
FIGS. 5A, 5B show longitudinal sections through a proportioning dispenser with two pump units in the basic position and in a delivering position, respectively.
Figure 5B:
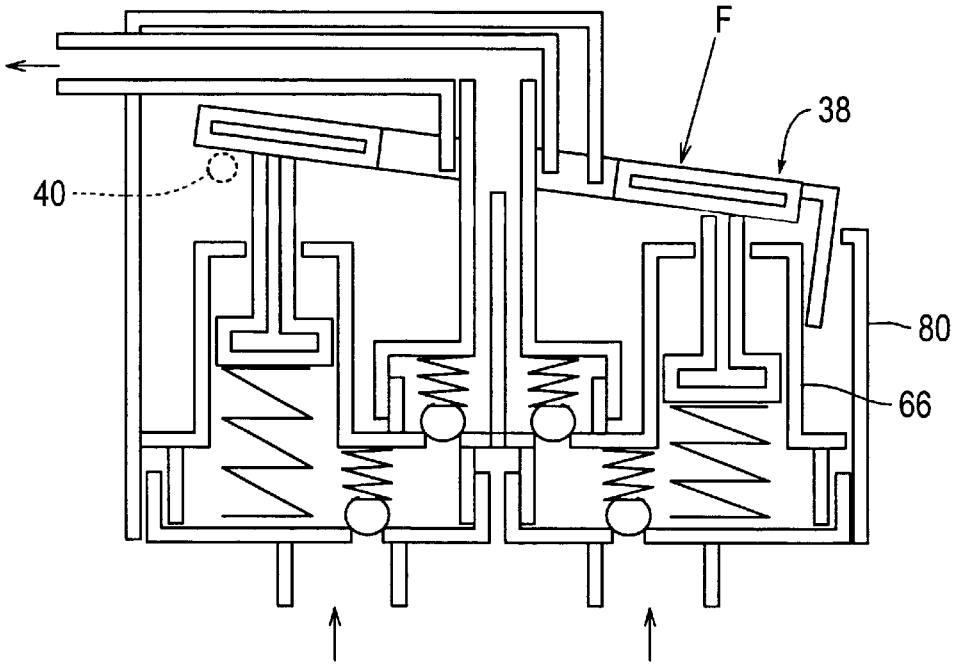

FIG. 5A shows the proportioning dispenser in its basic position, while in FIG. 5B the pump units 12*a*, 12*b* are shown in their supplying position.

The housing head 46 has a circumferential wall 80 and a bottom 82 at which two connecting flanges 84 are formed. The accommodating compartments, for example cartridges, glasses, bags, for the components of the mixture can be fixed thereto. The front end of the housing head 46 is formed by the front face 54. In the housing head 46, the cylinders 66 of the two pump units 12*a*, 12*b* are fixed such that between the bottom 82 and the cylinders 66 and the plunger 26 the displacer room 68 is formed. Each displacer room 68 is connected with the suction channel 70 encompassed by the connecting flange 84 via an opening 86.

The openings 86 each form a valve seat for the inlet valve 72 the valve spring of which is supported at a ring shoulder 88 of the cylinder 66.

The pressure channel 74 extends approximately into the direction towards the axis of the housing head 46, a further opening 90 being embodied in a wall via which the pressure channel 74 is connected with a mixing chamber 92. The opening 90 in turn forms a seat for the valve body of the outlet valve 76, the valve spring of which is supported at a shoulder of the mixing chamber 92. As can be taken from the representation according to FIGS. 5A, 5B, the valves 72, 76 are arranged in the region between the two pump units 12*a*, 12*b*, such that the proportioning dispenser 44 can be designed with an essentially shorter axial length than in the solutions mentioned at the beginning, in which the valve means were formed in front of or behind the pump units 12*a*, respectively, seen in the axial direction.

The pressure channels 74 of both pump units 12*a*, 12*b* end in the common proportioning or mixing chamber 92, where a static mixer 94 can be additionally arranged for enhancing a mixing.

The individual rooms of the housing head 46 are limited by elements preferably made by injection moulding, which are interconnected by suitable latch or threaded joints. The geometric design of these individual elements of the housing head is of minor importance for the comprehension of the invention, so that further embodiments with reference to the drawings are dispensable.

The mixed components are conveyed to the dispenser nozzle 52 radially projecting from the housing head 46 via a central proportioning channel 96.

The operation of the plunger 26 of the pump units 12*a*, 12*b* is effected via the transmission member 38—annular in this embodiment—which can be rotated about the pivoting axle 40 indicated by a dotted line. In this embodiment, the pivoting axle 40 is formed in one piece with the transmission member 38 and mounted in the housing head 46 in a manner not represented more in detail. The annular transmission member 38 has an internal recess 98 which is penetrated by the mixing channel 96 leading to the dispenser nozzle 52.

The operating section 62 of the transmission member 38 indicated in FIG. 3 extends out of the recess 60 of the housing head 46. By applying the operating force F, the transmission member 38 can be pivoted about the pivoting axle 40 and brought into the position represented in FIG. 5B, so that the two pump units 12*a*, 12*b* are operated in response to the relative position of the pivoting axle. In the process, the components are delivered from the displacer room 68 via the pressure channel 74, the outlet valves 76 lifted off the associated valve seats 90, the mixing chamber 92 and the proportioning channel 96 to the dispenser nozzle 52. When the transmission member 38 is relieved, the pump units are moved back into their basic position shown in FIG. 5A by means of the force of the pressure springs 78, so that the components are taken in via the suction channel 70 and the suction valves 72 lifted off the openings 86 into the respective displacer rooms 68 of the pump units 12*a*, 12*b*.

In the embodiment shown in FIGS. 5A, 5B, the transmission member 38 is provided with a circumferential surface 100, so that the recess 60 is covered towards the interior space. When the transmission member 38 is pivoted, this circumferential surface 100 is immersed in a space between the cylinder 66 and the circumferential wall 80.

In all embodiments described above, the displacer 26 of the pump units 12*a*, 12*b* were operated indirectly or directly via the transmission member 38.

That is, the kinematic reversal can for example consist in the transmission member acting onto the accommodating compartments movably guided within the housing and these in turn acting on the pump units. Here, the displacers can be stationarily mounted in the housing while the cylinder diameters can be displaced with the accommodating compartments. On the contrary, the displacers can also be connected with the accommodating compartments and the cylinders stationarily mounted in the housing.

In the embodiment discribed at the beginning, too, the cylinders could be displaced with respect to statoinary displacers via the transmission member.

Figure 6A:
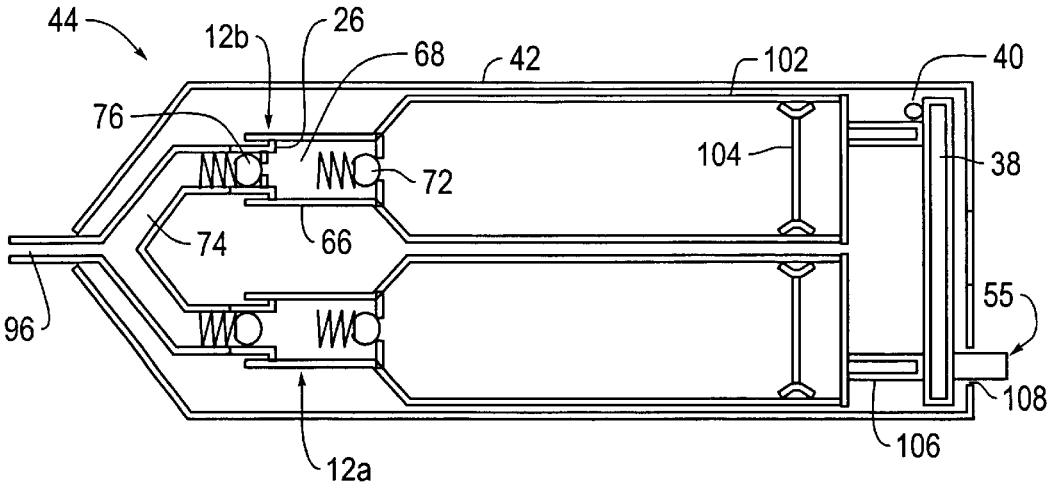
FIGS. 6A, 6B show an embodiment of a proportioning dispenser in a basic and a delivering position in which the pump units can be operated via axially displaceable cartridges.
Figure 6B:
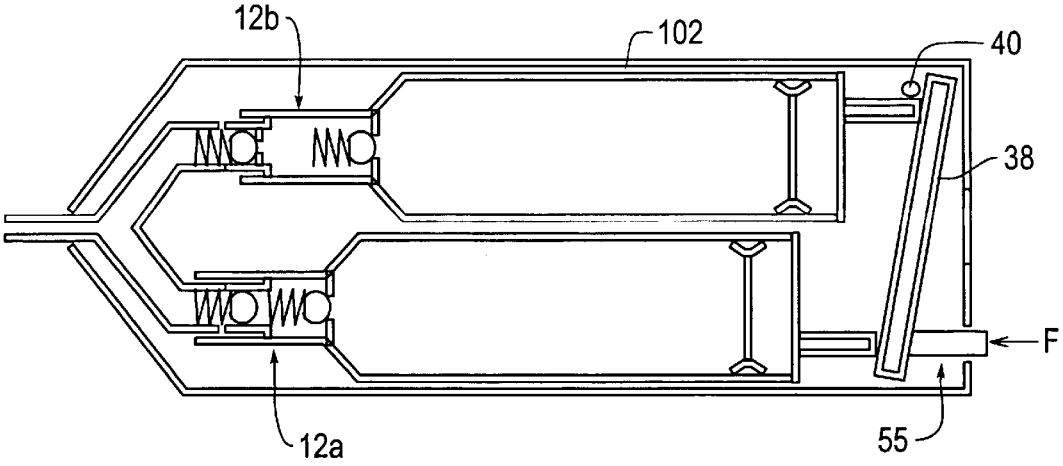

An embodiment based on a kinematic reversal is schematically represented in FIGS. 6A, 6B.

Accordingly, in the housing 42 of the proportioning dispenser 44, in turn two pump units 12*a*, 12*b* are accommodated which have a design including plungers. The plungers 26 are stationarily mounted in the housing 12 and embodied as so-called hollow plungers, the outlet or pressure valves being formed in a pressure channel 74 connected with the plunger 26. The individual pressure channels 74 of the pump units 12*a*, 12*b* can end in a common mixing channel 96. The cylinders 66 of the pump units are axially displaceably arranged in the housing 42 and fixed to a cartridge 102 each, in which the components are accommodated. In the transition region between the cartridge 102 and the cylinder 66, the suction valve 72 is formed, so that a backflow of the component from the displacer room 68 into the cartridge 102 is avoided. In the represented embodiments, each cartridge 102 is provided with a sealing plunger 104 which moves from the represented position to the left towards the inlet valve 72 as the cartridge 102 is emptied. The cartridges 102 and the cylinders 66 are axially displaceably guided in the housing 42.

The transmission member 38 is mounted in the bottom region of the housing 42 remote from the pump units 12*a*, 12*b* and can in turn be pivoted about an adjustable pivoting axle 40. Differing from the embodiments mentioned above, the transmission member 38 accordingly does not act onto the displacers 26 but onto the cartridges 102, so that the same are displaced into the axial direction when the transmission member 38 is pivoted. Due to this axial displacement of the cartridges 102, the associated cylinders 66 are also displaced with respect to the displacers 26, so that the displacer room 68 is reduced in size (delivery stroke) or enlarged (suction stroke). In the represented embodiment, the transmission of the pivoting movement of the transmission member 38 is effected via contact pins 106 formed at the bottoms of the cartridges 102.

The pivoting of the transmission member 38 is effected via a handle 55 extending through the bottom 108 of the housing 42. In this embodiment, the design of the cartridges 102 has to be sufficiently rigid in order to convert the pivoting of the transmission member 38 into an axial displacement of the cylinders 66.

In order to increase the operation security of the proportioning dispenser 44, blocking elements can be associated to the pump units 12*a*, 12*b* or to the transmission member 38, which prevent an operation in an excessively inclined position of the proportioning dispenser 44. Such blocking elements can for example be designed as safety catches actuated by gravity, similar to a safety belt. This variant is particularly advantageous when delivering low-viscosity components (liquids) where the accommodating compartments are formed by bottles with suction tubes. The operation of the pump units 12*a*, 12*b* is only possible if liquid can be taken in via the suction tube of the bottle.

In the above described embodiments, the components were supplied to a common central mixing chamber 92. In principle, the individual components could, however, also be conveyed separately to the dispenser nozzle, so that no internal through mixing takes place. The dispenser nozzle 52 can project from the front face 54 of the housing head 46 in the radial direction or centrally.

In order to reduce the operation forces when mixing very viscous components, suitable handles by which a greater lever action can be adjusted can be fixed to the transmission member.

A proportioning dispenser for proportioning at least two components which are supplied from an associated accommodating compartment each via a pump unit is disclosed. The adjustment of the mixing ratio is effected via a transmission member the point of application of which is adjustable with respect to the two pump units.

What is claimed is:

1. A proportioning dispenser for proportioning at least two components accommodated each in an accommodating compartment with a pump means in communication with each of the accommodating compartments, an adjustment means operationally connected with the pump means for adjusting the quantitative proportion of the components, and a dispenser nozzle for discharging the components, characterized in that the adjustment means comprises a pivotable transmission member which indirectly or directly contacts the pump means for the operation thereof and which is rotatable about a vertical/upright axis (H) together with a substantially horizontal pivoting axle for adjustment with respect to the pump means, so that the displacement volume of the pump means can be adjusted in response to the relative rotational position of the pivoting axle about said upright axis.

2. The proportioning, dispenser according to claim 1, wherein the pivoting axle is formed at the transmission member and rotatably mounted in a housing.

3. The proportioning dispenser according to claim 1, wherein the relative position of the pivoting axle can be changed with respect to the transmission member.

4. The proportioning dispenser according to claim 1, wherein the transmission member has a plate-shaped, disk-shaped or annular design.

5. The proportioning dispenser according to claim 2, wherein the pivoting axle is designed as an axle journal diametrically projecting from the transmission member, the end sections of which are mounted in the housing.

6. The proportioning dispenser according to claim 3, wherein the pivoting axle is designed at the housing and acts as a support for the transmission member mounted stationarily with respect to the housing.

7. The proportioning dispenser according to claim 6, wherein the pivoting axle is designed at the internal circumferential wall of a rotatable housing head.

8. The proportioning dispenser according to claim 1, wherein at the circumferential wall of a housing head a recess is designed through which an operating section of the transmission member is accessible for pivoting the same.

9. The proportioning dispenser according to claim 8, wherein the dispenser nozzle is arranged diametrically to the operating section.

10. The proportioning dispenser according to claim 8, wherein a handle is fixed to the operating section.

11. The proportioning dispenser according to claim 10, wherein a common proportioning or mixing chamber is in communication with each of the pump means via an outlet valve.

12. The proportioning dispenser according to claim 11, wherein the mixing chamber is embodied in the transmission member which in turn is in communication with displacers of the pump unit.

13. The proportioning dispenser according to claim 1, having suction channels each being associated to one pump means and in communication with a displacer room of a pump unit via an inlet valve, and having at least one chamber at the side of the outlet in communication with the displacer room via an outlet valve and connected to the dispenser nozzle.

14. The proportioning dispenser according to claim 13, wherein the chambers are arranged between the pump units.

15. The proportioning dispenser according to claim 1, wherein a pump unit is designed as a reciprocating, diaphragm or bellows pump.

16. The proportioning dispenser according to claim 1, wherein the accommodating compartments are designed as cartridges with an integrated plunger.

17. A proportioning dispenser according to claim 1, wherein the accommodating compartments are displaceably accommodated in the housing and in communication with a plurality of cylinders accommodating displacers, the transmission member acting on the accommodating compartments for effecting a stroke.

18. The proportioning dispenser according to claim 1, wherein the accommodating compartments are displaceably accommodated in the housing and in communication with displacers, the transmission member acting on the accommodating compartments for effecting a stroke.

* * * * *